US007225766B2

(12) United States Patent
Zahdeh

(10) Patent No.: US 7,225,766 B2
(45) Date of Patent: Jun. 5, 2007

(54) ENGINE CYLINDER COOLING JACKET

(75) Inventor: Akram R. Zahdeh, Oakland Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 11/002,389

(22) Filed: Dec. 2, 2004

(65) Prior Publication Data

US 2005/0235931 A1 Oct. 27, 2005

Related U.S. Application Data

(60) Provisional application No. 60/564,198, filed on Apr. 21, 2004.

(51) Int. Cl.
*F02F 1/14* (2006.01)

(52) U.S. Cl. ..... 123/41.79

(58) Field of Classification Search ..... 123/41.79, 123/41.67, 41.01

See application file for complete search history.

(56) References Cited

U.S. PATENT DOCUMENTS 6,289,855 B1 * 9/2001 Romblom et al. ..... 123/41.74

* cited by examiner

*Primary Examiner*—Tony M. Argenbright
*Assistant Examiner*—Katrina Harris
(74) *Attorney, Agent, or Firm*—John E. Kajander

(57) ABSTRACT

A coolant jacket for an engine cylinder bank having longitudinally aligned cylinders includes upper, lower and side walls defining two inlet flow galleries extending along the intake and exhaust sides of the cylinder bank and communicating with the upper ends of the cylinders. Two outlet flow galleries extend along the intake and exhaust sides of the cylinders and communicate with the lower ends of the cylinders and pairs of side flow slots extend between the upper and lower galleries and around the intake and exhaust sides of each of the cylinders. The side flow slots are separated along longitudinal edges from the slots of adjacent cylinders. Preferably, cooling fins extend into the flow galleries, forming pockets at the ends of the flow slots, the fins being impacted by coolant flow directed into the pockets to improve cooling of siamesed portions of the cylinders. Additional features are disclosed.

6 Claims, 5 Drawing Sheets

ENGINE CYLINDER COOLING JACKET

CROSS-REFERENCE TO RELATED APPLICATIONS

This application claims priority from U.S. Provisional Application No. 60/564,198 filed Apr. 21, 2004.

TECHNICAL FIELD

This invention relates to internal combustion engines and, more particularly, to a cooling jacket for directing coolant flow to cylinders in a cylinder bank of an engine.

BACKGROUND OF THE INVENTION

It is known in the engine art to provide liquid cooling of the cylinders by flowing coolant through a coolant jacket surrounding the cylinders. Conventional systems for a cylinder bank generally direct coolant flow longitudinally past the aligned cylinders from one end of the bank to the other. The cylinders are cooled by the passing coolant through contact with the cylinder walls. Increasing temperatures of the coolant from the inlet end to the outlet end of the jacket tend to cool the cylinders unevenly and may allow steam pockets to form near the outlet end at high engine loads.

SUMMARY OF THE INVENTION

The present invention provides an improved coolant jacket in which coolant is delivered by inlet galleries to upper ends of the cylinders (adjacent the combustion chambers). The coolant is distributed equally to side flow slots along the cylinders and flows axially downward along the cylinders to cooler lower ends where it is collected in outlet galleries and discharged from the jacket.

The coolant jacket is preferably separated into intake and exhaust sides of the cylinder bank and provided with separate inlet and outlet galleries for each side. The galleries are configured with varying flow passages to provide equal and separate coolant flow with each cylinder having equal coolant temperatures.

With siamesed cylinders, lateral cooling fins may extend between the adjacent cylinders and protrude into the coolant jacket for drawing heat from the joined cylinders into the coolant. The coolant galleries may have inwardly curved portions between the cylinders to direct coolant toward pockets formed where the fins join the cylinders.

The jacket design provides improved and equal cooling to all the cylinders with downward flow, which minimizes formation of steam pockets. If desired, exhaust side flow may be increased to provide more cooling to the exhaust heated portions of the cylinders.

These and other features and advantages of the invention will be more fully understood from the following description of certain specific embodiments of the invention taken together with the accompanying drawings.

DESCRIPTION OF THE PREFERRED EMBODIMENT

Figure 1:
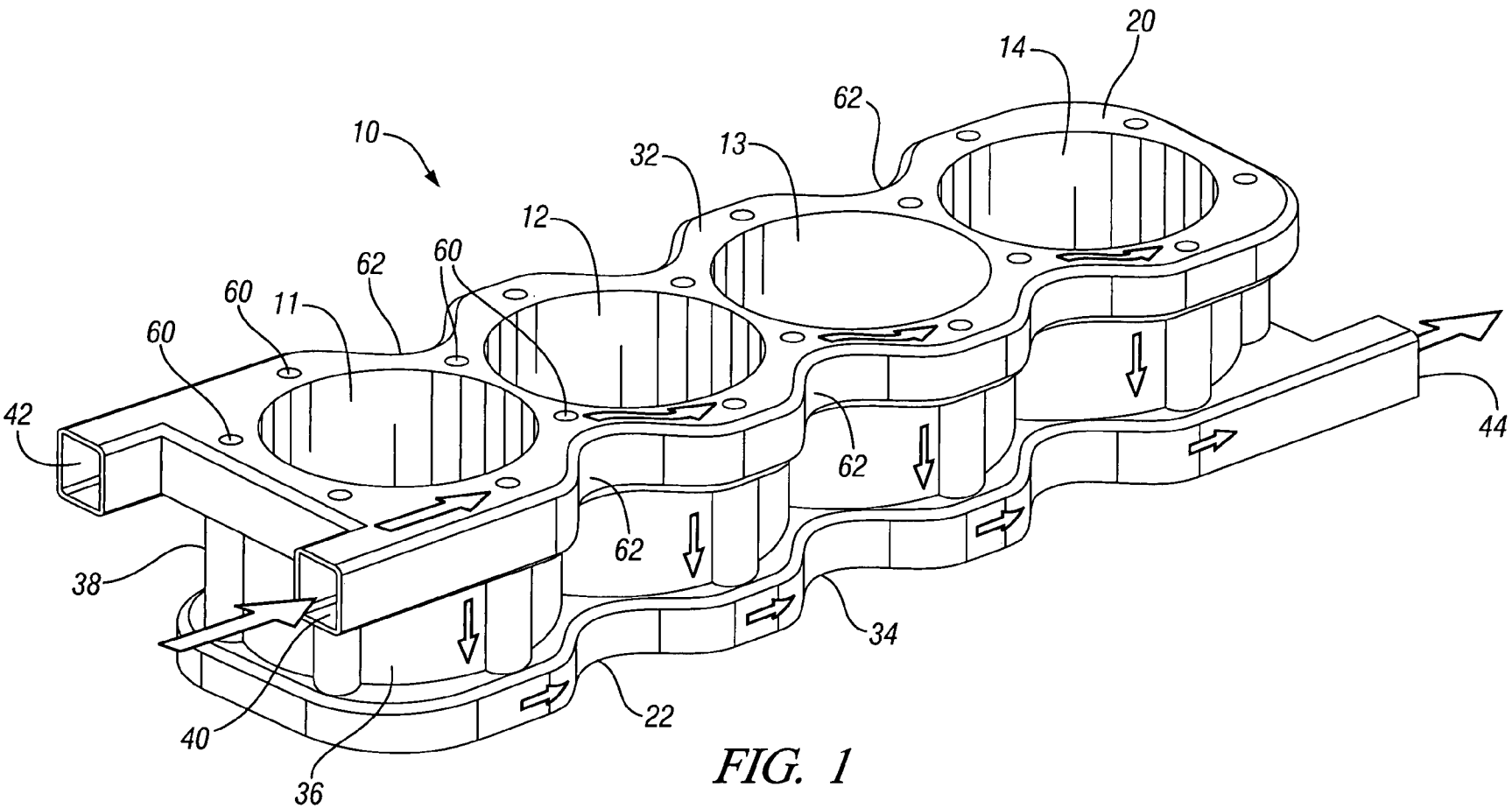
FIG. 1 is an isometric pictorial view showing the exterior structure of a cylinder cooling jacket according to the invention
Figure 2:
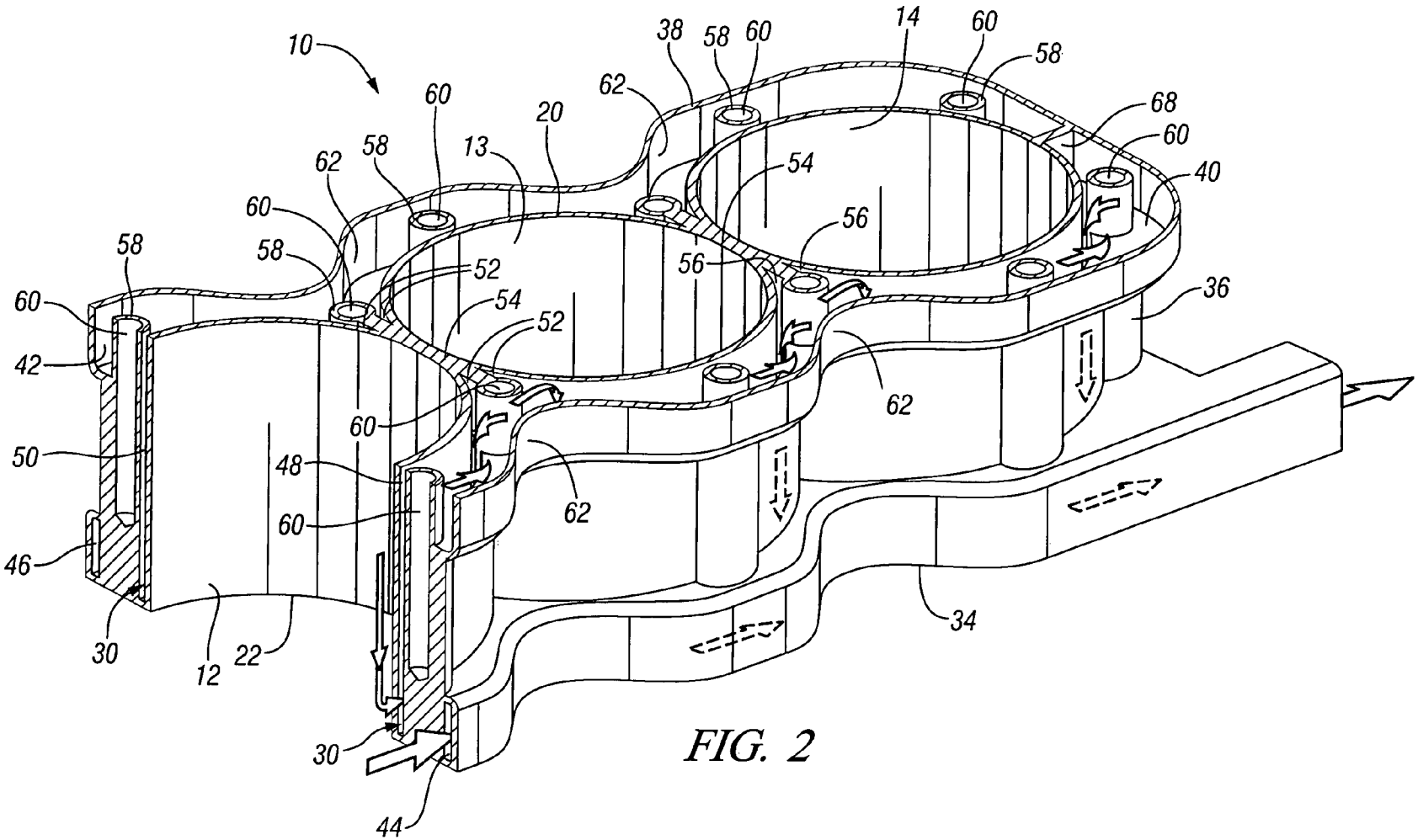
FIG. 2 is a sectional view of a portion of FIG. 1 showing interior features of the cooling jacket.
Figure 3:
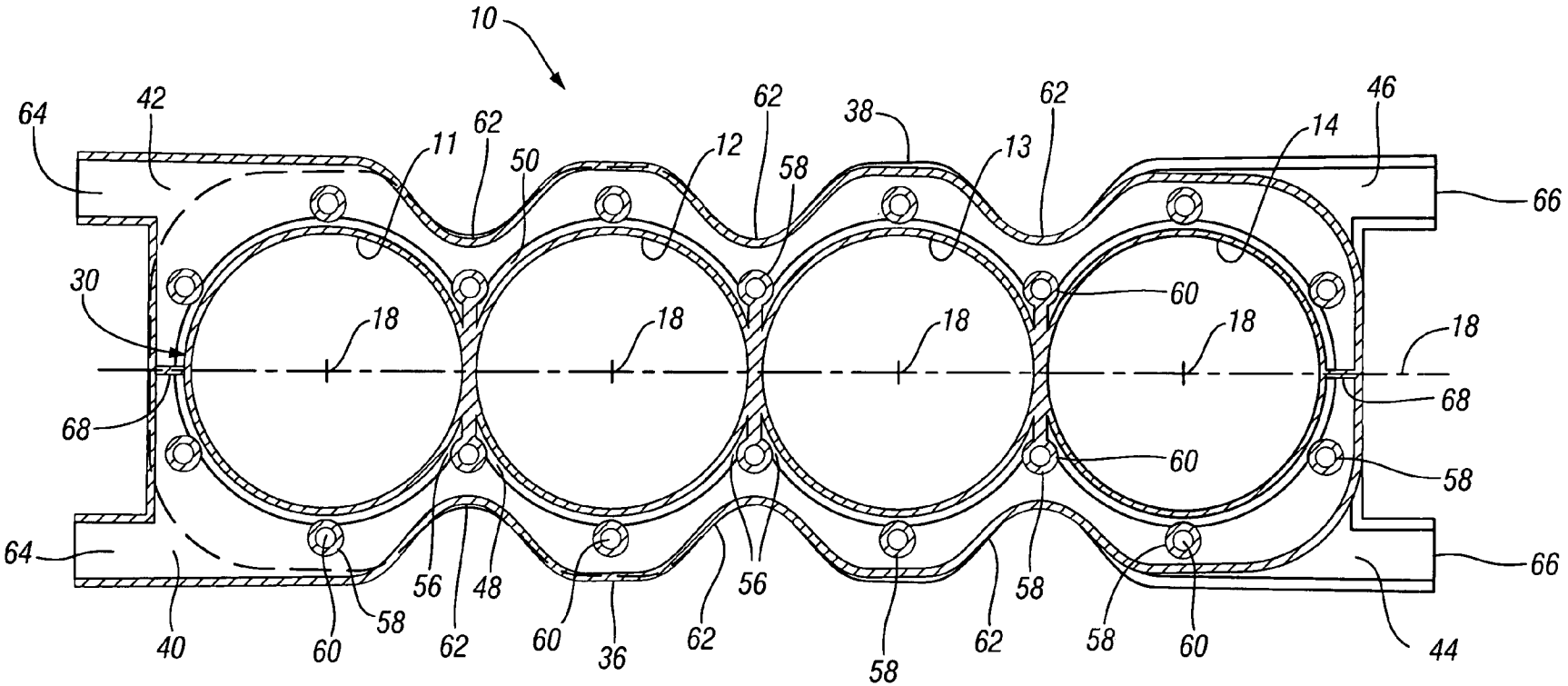
FIG. 3 is a planar cross-sectional plan view through the inlet flow galleries and outlet portions of the outlet flow galleries showing the interior features.
Figure 4:
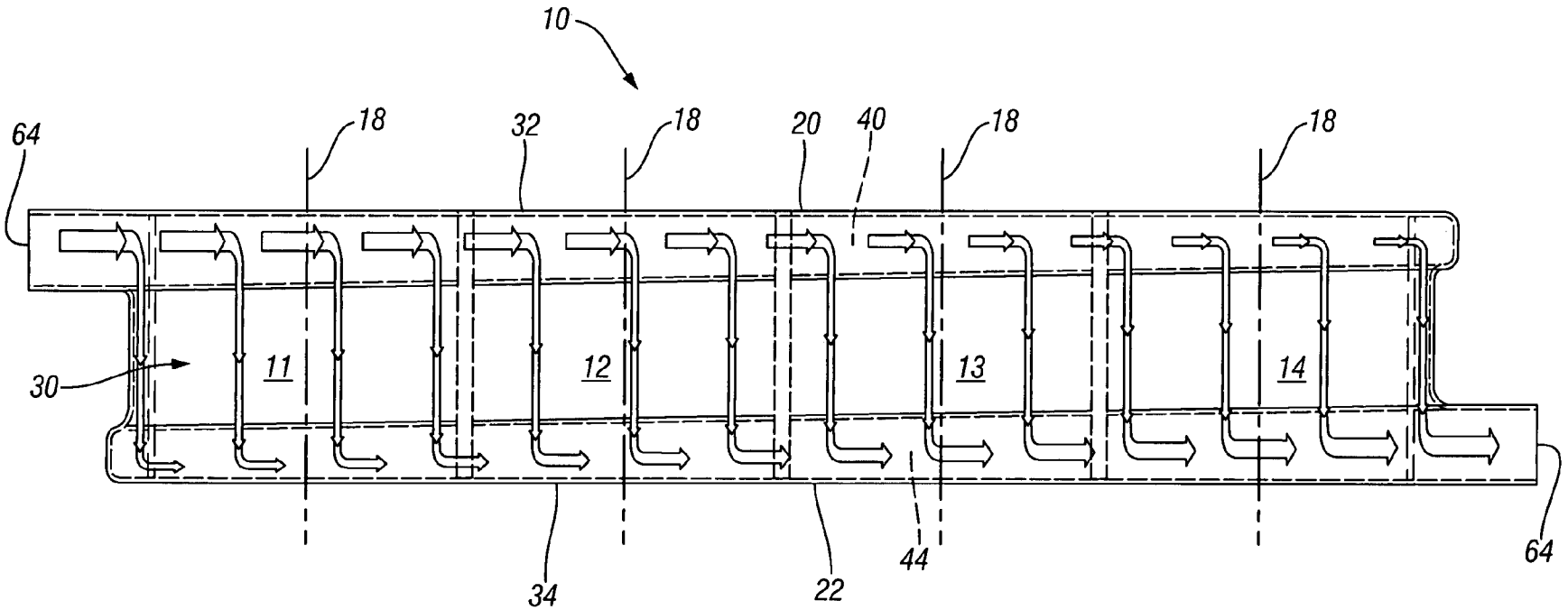
FIG. 4 is a side view showing interior features in dashed lines and illustrating the equal distribution of coolant flow to the four cylinders in the cylinder bank.
Figure 5:
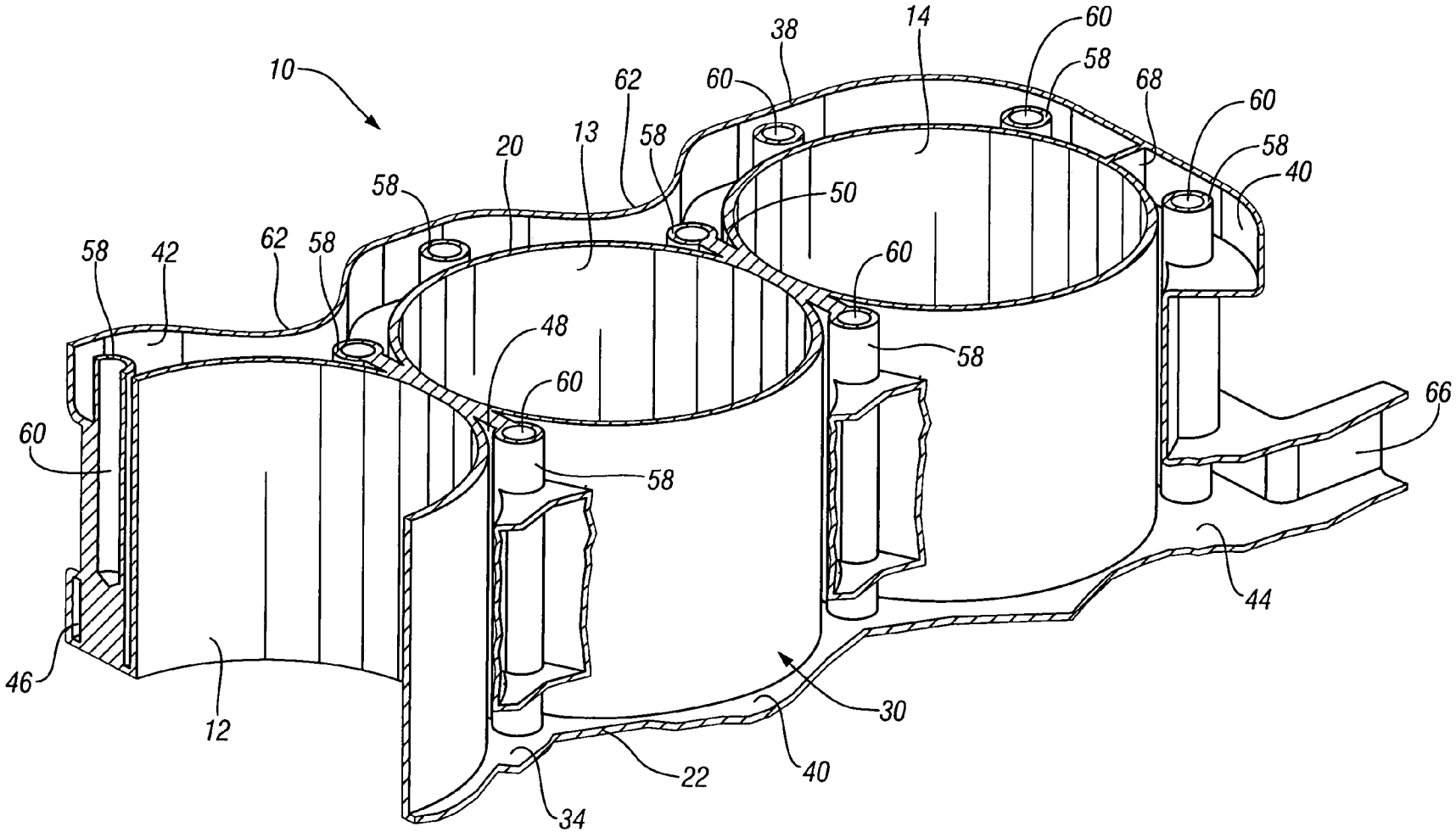
FIG. 5 is a fragmentary cross section similar to FIG. 2 but having the near side wall cut away to better show the cylinder construction.

Referring now to the drawings in detail, numeral 10 generally indicates an engine cylinder bank having a plurality of cylinders 11, 12, 13, 14 aligned along a longitudinal centerline 16 and extending on spaced parallel axes 18. The cylinders have upper ends 20 and lower ends 22 and are surrounded by a cooling jacket 30 The cylinder bank forms an upper end of an engine block having a crankcase portion, not shown, located conventionally below the cylinder bank. If desired, the engine may include multiple cylinder banks 10.

The cooling jacket 30 includes an upper jacket wall 32 and a lower jacket wall 34 extending outward from the upper and lower ends 20 22, respectively, of the cylinders 11–14. An inlet side jacket wall 36 extends along an inlet side of the cylinders and an exhaust side jacket wall 38 extends along an exhaust side of the cylinders. The intake and exhaust side walls 36, 38 form the sides of the cylinder bank and are aligned with a charge intake side and an exhaust outlet side, respectively, of a cylinder head, not shown, when the cylinder head is mounted on the cylinder bank 10.

The cooling jacket walls define two inlet flow galleries 40, 42 extending, respectively, along the intake and exhaust side walls 36, 38 of the cooling jacket 30 and communicating with the upper ends 20 of the cylinders. Two outlet flow galleries 44, 46 extend along the intake and exhaust sides 36, 38 of the cylinders and communicate with the lower ends of the cylinders. Pairs of side flow slots 48 50 extend downward between the upper and lower galleries and around the intake and exhaust sides, respectively, of each of the cylinders, the side flow slots, 48, 50 being separated along longitudinal edges 52 from the slots of the adjacent cylinders.

Adjacent pairs of the cylinders 11–14 are siamesed so that the cooling jacket 30 does not extend between the cylinders and that there is no coolant present in the siamesed bridge portions that extend between the adjacent cylinders. Instead, the siamesed portions each include a cooling fin 54 extending between each of the adjacent pairs of cylinders. The cooling fins extend laterally across the centerline 16 and between the longitudinally adjacent edges 52 of the side flow slots 48 50 to transmit heat from the siamesed portions to coolant flowing through the flow slots.

The cooling fins also extend into the flow galleries, forming pockets 56 at the edges 52 of the flow slots, the fins being impacted by coolant flow directed into the pockets. Preferably, the fins extend to cylinder head connecting pillars 58 which extend through the cooling jacket and include threaded bores 60 for attaching a cylinder head to the upper wall of the cylinder bank.

The inlet and outlet flow galleries 40, 42 preferably extend along the cooling jacket side walls 36, 38, the side walls being formed with inwardly curved portions 62 between the cylinders which direct coolant from the flow galleries 44, 46 toward the fins 54 between the cylinders to further assist cooling by directing coolant against the fins and down into the slots. As portions of the coolant are directed down the slots 48, 50 beside each cylinder, the remaining portions pass around the ends of the fins 54 and the connecting pillars to be directed to the subsequent cylinders along the longitudinal centerline 16.

The inlet flow galleries 42, 44 are formed with decreasing cross-sectional flow areas from the first cylinder 11 at inlet ends 64 of the galleries to the last cylinder 14 at the distal ends of the galleries to distribute coolant flow equally to the cylinders from the flow through the cooling jacket. Conversely, the outlet flow galleries 44, 46 are formed with increasing cross-sectional flow areas for outlet flow from the first cylinder 11 to the last cylinder 14 at discharge ends 66 of the outlet galleries to maintain a relatively constant flow rate of the coolant in the galleries.

In operation, the cylinders 11–14 are heated by combustion gas, with the most heat being absorbed at the upper ends 20 of the cylinders where initial combustion takes place. Less heat is absorbed toward the lower ends 22 of the cylinders where the combustion gases have lower energy and have been cooled by expansion.

The inlet flow galleries 40, 42 and the outlet flow galleries 44, 46 are separated between the cylinders and by separating walls 68 along the centerline 16 of the cylinder bank 10 at longitudinal ends of the galleries. Liquid coolant, such as a water-antifreeze mixture, is directed into the inlet ends 64 of the inlet flow galleries 40, 42 of the cylinders from the first cylinder 11 to the fourth cylinder 14.

From the galleries 40, 42 an approximately equal portion of the coolant flow is directed into the side flow slots 48, 50 of each of the cylinders in sequence. Thus, some of the flow enters the side flow slots of the first cylinder 11 and some is directed by the inwardly curved portions 62 of the side walls 36, 38 into engagement with the cooling fin 54 between cylinders 11 and 12. This coolant flows down along the fin 54 and the adjacent edges 52 of the flow slots, helping to cool the siamesed portion of the cylinders by drawing heat out of the uncooled portion along the transverse fin. This process is repeated at each of the cylinders until, at the fourth cylinder 14, the remainder of the water in the inlet flow galleries is directed down the flow slots 48, 50 for the fourth cylinder 14.

Water or coolant flowing down thru the flow slots of each of the cylinders passes into the outlet flow galleries 44, 46 below and is directed from the first cylinder 11 to the last cylinder 14 and out thru discharge ends 66 of the outlet flow galleries. Shaping of the cross-sectional configurations of the inlet and outlet flow galleries with diminishing cross-sectional areas in the inlet flow galleries from cylinder 11 to cylinder 14 and increasing cross-sectional areas in the same direction of the outlet flow galleries helps divide the flow equally between the cylinders so that all are cooled with an equal amount of coolant.

With this arrangement, the coolant flow along the cylinders starts at the hottest parts of cylinders, near the upper ends 20, and passes downward along the sides of the cylinders to enter the outlet galleries at the coolest portions, the lower ends 22 of the cylinders. This provides very even temperatures across both the sides and lengths of the cylinders from their upper to their lower ends.

Because the connecting bosses or pillars 56 extend vertically, they do not interfere with coolant flow downward along the cylinder walls. Cross-sectional areas of the spaces outwardly of the bosses are varied to control passage of cooling water from one cylinder to the next in the amounts needed for equally cooling all of the cylinders. The relatively thin side flow slots are designed to force the coolant flow to hug to cylinders as it flows down around them, while providing excellent and even cooling of the cylinders.

It should be recognized that the cylinder coolant flow is in parallel along each of the cylinders so that the coolant that cools one of the cylinders is separate from that which cools each of the others. Thus, each cylinder is cooled by a separate portion of the coolant flow and each is provided with coolant that begins at approximately the same temperature and is heated along the length of the cylinders until it is discharged and mixed with the existing coolant in the outlet flow galleries at approximately the same temperature it leaves each of the cylinders.

Because of the various features disclosed, cooling of the cylinders is very effective and is designed to minimize hot spots so that the formation of steam bubbles is substantially avoided, even during operation at the maximum load condition of the engine.

Division of the coolant jacket into intake and exhaust sides provides the possibility, if desired, of varying the coolant flow between the two sides. Since charge air flow in the cylinders is generally from the intake side to the exhaust side, the cylinders on the exhaust side may run hotter and call for additional coolant. This could be accomplished by providing flow control orifices in the inlet or outlet flow galleries or by varying the gallery flow areas to obtain the relative flow rates desired.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A cooling jacket for an internal combustion engine having a cylinder bank including a plurality of longitudinally aligned cylinders centered on spaced parallel axes and having upper and lower ends, the cooling jacket comprising:

upper and lower jacket walls extending outward from the upper and lower ends of the cylinders and intake and exhaust side jacket walls between the upper and lower walls and enclosing opposite charge inlet and exhaust outlet sides of the cylinders;

the walls defining two inlet flow galleries extending along the intake and exhaust sides of the cylinder bank and communicating with the upper ends of the cylinders, two outlet flow galleries extending along the intake and exhaust sides of the cylinders and communicating with the lower ends of the cylinders, and pairs of side flow slots extending between the upper and lower galleries and around the intake and exhaust sides of each of the cylinders; the side flow slots being separated along longitudinal edges from the slots of adjacent cylinders;

whereby cooling fluid introduced to the top of the cylinders through the inlet flow galleries is divided and directed down through the side flow slots of the several cylinders and collected into the outlet flow galleries for discharge to a heat exchanger.

2. A cooling jacket as in claim 1 wherein the intake side galleries and the exhaust side galleries are separated so that the intake side galleries communicate only with intake side flow slots and the exhaust side galleries communicate only with exhaust side flow slots to separately distribute cooling fluid to intake and exhaust sides of the cylinders.

3. A cooling jacket as in claim 1 wherein the longitudinally aligned cylinders of the cylinder bank have siamesed portions between each of adjacent pairs of cylinders and include a cooling fin between the adjacent cylinders and extending laterally between longitudinally adjacent side flow slots to transmit heat from the siamesed portions to the coolant in the adjacent flow slots.

4. A cooling jacket as in claim 3 wherein the cooling fins extend into the flow galleries, forming pockets at the ends of the flow slots the fins being impacted by coolant flow directed into the pockets to improve cooling of the siamesed portions of the cylinders.

5. A cooling jacket as in claim 4 wherein the galleries extend along laterally outer edges of the cylinders forming inwardly curved portions between the cylinders which direct coolant from the flow galleries toward the fins between the cylinders to further assist cooling, spaces outward of the fins allowing coolant to flow past outer ends of the fins to cool subsequent cylinders connected with the galleries.

6. A cooling jacket as in claim 1 wherein the inlet flow galleries have decreasing flow areas from a first cylinder at inlet ends of the galleries to a last cylinder at distal ends of the galleries and the outlet flow galleries have increasing flow areas from the first to the last cylinder to aid in distributing coolant flow equally to the cylinders.

* * * * *